US006357538B2

(12) United States Patent
Tibbitts

(10) Patent No.: US 6,357,538 B2
(45) Date of Patent: Mar. 19, 2002

(54) BIT TORQUE LIMITING DEVICE

(75) Inventor: Gordon A. Tibbitts, Salt Lake City, UT (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/731,109

(22) Filed: Dec. 6, 2000

Related U.S. Application Data

(62) Division of application No. 09/172,509, filed on Oct. 14, 1998, now Pat. No. 6,182,774, which is a division of application No. 08/821,465, filed on Mar. 21, 1997, now Pat. No. 5,947,214.

(51) Int. Cl.[7] ..... E21B 10/36

(52) U.S. Cl. ..... 175/274; 29/466; 175/292; 175/306

(58) Field of Search ..... 175/327, 274, 175/305, 306, 292, 414, 415; 76/5.1, 108.1–108.3, DIG. 11, DIG. 12; 29/428, 456, 466–468, DIG. 4, DIG. 5

(56) References Cited

U.S. PATENT DOCUMENTS

| | | | |
|---|---|---|---|
| 1,518,634 | A | 12/1924 | Cason, Jr. |
| 3,585,818 | A | 6/1971 | Helble |
| 3,757,878 | A | 9/1973 | Wilder et al. |
| 3,757,879 | A | 9/1973 | Wilder et al. |
| 3,858,669 | A | 1/1975 | Jeter |
| 3,884,592 | A | 5/1975 | Shulters |
| 3,893,554 | A | 7/1975 | Wason |
| 3,939,670 | A | 2/1976 | Amtsberg |
| 3,964,558 | A | 6/1976 | Fogle |
| 3,969,961 | A | 7/1976 | Amoroso |
| 3,981,186 | A | 9/1976 | Rauch et al. |
| 4,006,608 | A | 2/1977 | Vuceta |
| 4,102,154 | A | 7/1978 | Dahlstrand, Jr. |
| 4,137,975 | A | 2/1979 | Pennock |
| 4,195,699 | A | 4/1980 | Rogers et al. |
| 4,228,723 | A | 10/1980 | Cunningham |
| 4,244,433 | A | 1/1981 | Kellner |
| 4,280,606 | A | 7/1981 | Taylor |
| 4,290,516 | A | 9/1981 | West et al. |
| 4,313,495 | A | 2/1982 | Brandell |
| 4,338,798 | A | 7/1982 | Gilman |
| 4,511,050 | A | 4/1985 | Hughes et al. |
| 4,564,068 | A | 1/1986 | Baugh |
| 4,655,479 | A | 4/1987 | Farr, Jr. |
| 4,729,430 | A | 3/1988 | White et al. |
| 4,768,598 | A | 9/1988 | Reinhardt |
| 4,799,833 | A | 1/1989 | Pennison et al. |

(List continued on next page.)

FOREIGN PATENT DOCUMENTS

| | | |
|---|---|---|
| EP | 0 151 365 A2 | 8/1985 |
| FR | 2 634 515 A1 | 7/1989 |
| GB | 2 142 066 A | 1/1985 |

*Primary Examiner*—Roger Schoeppel
(74) *Attorney, Agent, or Firm*—TraskBritt

(57) ABSTRACT

A torque limiting device that allows a drill string to rotate relative to the cutting structure of the bit when a predetermined torque is applied between the cutting structure of the drill bit and the drill string. The torque limiting device utilizes a retaining member which restricts rotational movement of a first component of the torque limiting device relative to a second component. When a sufficient torque load is placed on the cutting structure of the drill bit, the retaining member allows rotational movement of the first component relative to the second component and allows the drill string to continue to rotate relative to the cutting structure of the bit until the torque is sufficiently reduced. The torque limiting device may be an integral part of a drill bit, may be a separate device attached between the drill string and the drill bit or between the drill string and a downhole motor, or may be part of a near-bit sub or incorporated in a downhole motor.

18 Claims, 13 Drawing Sheets

U.S. PATENT DOCUMENTS

| | | | | |
|---|---|---|---|---|
| 4,852,399 | A | | 8/1989 | Falconer |
| 4,864,882 | A | | 9/1989 | Capewell |
| 4,877,086 | A | | 10/1989 | Zunkel |
| 4,901,806 | A | | 2/1990 | Forrest |
| 5,031,742 | A | | 7/1991 | Dischler |
| 5,035,311 | A | | 7/1991 | Girguis |
| 5,090,491 | A | | 2/1992 | Tibbitts et al. |
| 5,101,692 | A | | 4/1992 | Simpson |
| 5,137,087 | A | | 8/1992 | Szarka et al. |
| 5,160,006 | A | | 11/1992 | Dischler |
| 5,199,501 | A | | 4/1993 | Kluber et al. |
| 5,316,093 | A | | 5/1994 | Morin et al. |
| 5,323,852 | A | | 6/1994 | Cornette et al. |
| 5,361,859 | A | * | 11/1994 | Tibbitts |
| 5,373,907 | A | | 12/1994 | Weaver |
| 5,411,275 | A | | 5/1995 | Huff et al. |
| 5,433,280 | A | | 7/1995 | Smith |
| 5,441,121 | A | | 8/1995 | Tibbitts |
| 5,448,227 | A | | 9/1995 | Orban et al. |
| 5,453,241 | A | | 9/1995 | Åkerman et al. |
| 5,503,236 | A | | 4/1996 | Tibbitts |
| 5,531,461 | A | | 7/1996 | Huff et al. |
| 5,560,440 | A | * | 10/1996 | Tibbitts |
| 5,588,496 | A | | 12/1996 | Elger |
| 5,588,916 | A | | 12/1996 | Moore |
| 5,630,490 | A | | 5/1997 | Hudson et al. |
| 5,695,015 | A | | 12/1997 | Barr et al. |
| 5,947,214 | A | | 9/1999 | Tibbitts |

* cited by examiner

BIT TORQUE LIMITING DEVICE

CROSS-REFERENCE TO RELATED APPLICATIONS

This application is a divisional of application Ser. No. 09/172,509, filed Oct. 14, 1998, now U.S. Pat. No. 6,182,774, which is a divisional of application Ser. No. 08/821,465, filed Mar. 21, 1997, now U.S. Pat. No. 5,947,214, issued Sep. 7, 1999.

BACKGROUND OF THE INVENTION

1. Field of the Invention

This invention relates generally to rotary drill bits used in drilling subterranean wells and, more specifically, to rotary drill bits employing a torque limiting device allowing the drill string to rotate relative to the crown of the bit when a predetermined reactive torque is experienced by the crown of the drill bit.

2. State of the Art

The equipment used in drilling operations is well known in the art and generally comprises a drill bit attached to a drill string, including drill pipe and drill collars. A rotary table or other device such as a top drive may be employed to rotate the drill string, resulting in a corresponding rotation of the drill bit. The drill collars, which are heavier and stiffer than drill pipe, are normally used on the bottom part of the drill string to add weight to the drill bit. The weight of these drill collars assists in stabilizing the drill bit against the formation at the bottom of the borehole, causing it to drill when rotated. Too much weight on bit (WOB), however, may cause the drill bit to stall.

Downhole motors may also be employed to rotate the drill bit and include two basic components: a rotor, which is a steel shaft shaped in the form of a spiral or helix, and a stator, which is a molded rubber sleeve in a rigid tubular housing, that forms a spiral passageway to accommodate the rotor. When the rotor is fitted inside the stator, the difference in geometry between the two components creates a series of cavities through which drilling fluid is pumped. In doing so, the fluid displaces the rotor, forcing it to rotate as the fluid continues to flow between the rotor and the stator. An output shaft connected to the rotor transmits its rotation to the bit.

A typical rotary drill bit includes a bit body secured to a steel shank having a threaded pin connection for attaching the bit body to the drill string or the output shaft of a downhole motor and a crown comprising that part of the bit fitted with cutting structures for cutting into an earth formation. Generally, if the bit is a fixed-cutter or so-called "drag" bit, the cutting structure includes a series of cutting elements made of a super-abrasive substance, such as polycrystalline diamond, oriented on the bit face at an angle to the surface being cut. On the other hand, if the bit has rotating cutters such as on a tri-cone bit, each cone independently rotates relative to the body of the bit and includes a series of protruding teeth, which may be integral with the cone or comprise separately formed inserts.

The bit body of a drag bit is generally formed of steel or a matrix of hard particulate material such as tungsten carbide infiltrated with a binder, generally of copper-based alloy. In the case of steel body bits, the bit body is usually machined from round stock to the shape desired, usually with internal watercourses for delivery of drilling fluid to the bit face. Topographical features are then defined at precise locations on the bit face by machining, typically using a computer-controlled, five-axis machine tool. For a steel body bit, hardfacing may be applied to the bit face and to other critical areas of the bit exterior, and cutting elements are secured to the bit face, generally by inserting the proximal ends of studs on which the cutting elements are mounted into apertures bored in the bit face. The end of the bit body opposite the face is then threaded, made up and welded to the bit shank.

In the case of a matrix-type drag bit body, it is conventional to employ a preformed so-called bit "blank" of steel or other suitable material for internal reinforcement of the bit body matrix. The blank may be merely cylindrical and tubular, or may be fairly complex in configuration and include protrusions corresponding to blades, wings or other features on the bit face. Other preform elements comprised of sand, or in some instances tungsten carbide particles, in a flexible polymeric binder may also be employed to define internal watercourses and passages for delivery of drilling fluid to the bit face, as well as cutting element sockets, ridges, lands, nozzle displacements, junk slots and other external topographic features of the bit. The blank and other preforms are placed at appropriate locations in the mold used to cast the bit body before the mold is filled with tungsten carbide. The blank is bonded to and within the matrix upon cooling of the bit body after infiltration of the tungsten carbide with the binder in a furnace, and the other preforms are removed once the matrix has cooled. The threaded shank is then welded to the bit blank. The cutting elements (typically diamond, and most often a synthetic polycrystalline diamond compact, or PDC) may be bonded to the bit face by the solidified binder subsequent to furnacing of the bit body. Thermally stable PDCs, commonly termed "TSPs", may be bonded to the bit face by the furnacing process or may be subsequently bonded thereto, as by brazing, adhesive bonding, or mechanical affixation.

In order for the cutting elements to properly cut the formation during a drilling operation, considerable torque is required to generate the necessary rotational force between the cutting elements and the formation under a WOB substantial enough to ensure an adequate depth of cut. The resultant or reactive torque on the bit from formation contact is translated through the drill string and must be overcome by the means used to rotate the drill string, such as a rotary table, top drive, or downhole motor. In some instances, such as drilling through harder formations, the resultant torque may result in the winding up and sudden release of the drill string under torque, manifested as so-called "slaps" of the drill string at the rotary table. In other instances, torque may be sufficient to actually stop the bit from rotating. The rotary table may continue to rotate the drill string for some time, in effect "twisting" the drill string and placing the bit under very high torque loads before an operator realizes that the bit is no longer rotating. This problem is of particular concern with drag bits, due to direct engagement of the formation by the fixed PDC cutters, but also manifests itself with rock bits. If such a condition occurs and the rotary table continues to rotate, the drill string, the bit and/or components thereof may be damaged, or the drill string may even part under the torque load. If failure of the drill string occurs, the portion of the drill string above the break must be removed from the wellbore. A "fishing" assembly inserted into the wellbore is then normally employed in an attempt to retrieve the remainder of the drill string. If retrieval is impractical or unsuccessful, a new drilling assembly must be deflected, "sidetracked," or steered around the "fish." Any such scenario adds to the cost of production and results in down-time of the drilling operation while the remainder of the broken drill string is "tripped" from the wellbore and replaced with other bottom hole assemblies.

When a downhole motor is being used to rotate the drill bit, a sudden rise in surface pressure of the drilling fluid may indicate that the motor has stalled. While other conditions may cause a rise in fluid pressure, such as a clogged motor or plugged nozzles, if the motor stalls because the bit is no longer rotating due to excessive torque on the bit and is maintained in a stalled condition, the elastomeric stator lining may be damaged, preventing a proper interface between the stator and the rotor, thus requiring the motor to be tripped out of the wellbore and replaced. At the least, the bottomhole assembly, including the motor, must be pulled off-bottom and drilling and circulation recommended to start the motor before the formation is re-engaged by the bit.

In addition to damage to drill strings and bits, directional drilling presents its own set of problems when excessive torque is applied to the drill bit. A directional well must intersect a target that may be several miles below the surface location of the drilling rig, and laterally offset therefrom. In order to reach the target, the wellbore must be directed or steered along a predetermined trajectory. The trajectory of the bit is typically determined by the tool face orientation (TFO), which must be maintained during drilling in order to maintain the trajectory of the wellbore toward the desired target. If the TFO shifts due to a stalled drill bit, the drilling must stop and a new TFO set as a reference point for the direction of drilling. While a shift in TFO is quickly manifested to the operator due to the essentially real-time nature of the MWD (measurement while drilling) mud-pulse transmissions, nonetheless, loss of TFO and resetting thereof results in considerable reduction in the overall rate of penetration (ROP) of the drilling assembly.

It would thus be advantageous to provide a drill bit assembly that includes a torque limiting device that is either an integral part of the bit construction or is attached near the bit between the drill bit and the drill string, or is positioned between the downhole motor and the drill bit.

BRIEF SUMMARY OF THE INVENTION

According to the present invention, a torque limiting device is provided that allows the drill string to rotate relative to the cutting structure of the bit at a predetermined torque placed on the cutting structure of the bit. The torque limiting device may be incorporated into the structure of the bit itself, be a separate structure attached to a drill bit, or be near-bit positioned between the drill string and the bit. In any case, the torque limiting device prevents movement of the cutting structure relative to the drill string during normal operation. When a predetermined torque is applied to the cutting structure of the bit, the torque limiter allows the drill string to rotate relative to the stationary cutting structure until the torque is decreased below the predetermined level, typically by backing off the drill string to decrease the WOB.

In a preferred embodiment having the torque limiting device as an integral part of a drill bit, the fixed-cutter bit is comprised of a crown for providing a cutting face to which a plurality of cutting elements may be attached and a shank for supporting the crown and attaching the crown to a drill string. The crown has a substantially cylindrical internal chamber sized and shaped to mate with and effectively cap the proximal end of the shank, which also has a generally cylindrical configuration. The shank and the crown fit together in a snug arrangement without inhibiting rotational movement between the crown and the shank.

In one preferred embodiment, around the perimeter of the shank are a number of recesses positioned to match corresponding recesses formed in the wall of the internal chamber of the crown. A biasing member comprised of a resilient material or a spring is placed in each recess formed in the shank. A retaining member, preferably made of a hard material such as steel, is subsequently placed on top of (radially outboard of) each of the biasing members. When the shank and crown are assembled together longitudinally, the retaining member compresses the biasing member and is forced by the wall of the internal chamber of the crown into the recess formed in the shank. The lower portion of the retaining member may be tapered to facilitate assembly of the torque limiting device. When the shank and crown are completely engaged, the biasing member forces the retaining member into the recess in the internal chamber wall.

If sufficient torque is applied to the crown of the bit, the retaining member is forced against the biasing member out of the recess in the internal chamber wall of the crown. The shank can then rotate relative to the crown. If a single retaining member and recess are utilized as part of the torque limiting device, the shank will make a complete revolution before the retaining member can reengage the recess. If the torque is still sufficient, the shank will continue to rotate until the torque is sufficiently decreased and the retaining member is realigned with the recess. Preferably, there is more than one retaining member and more than one recess spaced around the perimeter of the shank. Thus, the retaining member or members may reengage with other recesses, depending on when the torque is sufficiently lowered. In addition, the retaining member may be longitudinally oriented or oriented at some angle relative to the bit axis. Engagement or disengagement of the retaining member or members with the recesses manifests itself as vibrations on the rig floor, alerting the driller to reduce WOB.

In another preferred embodiment where the torque limiting device is part of the drill bit itself, the crown is securely attached to a substantially cylindrical bit blank. The blank and the shank are then attached in a manner similar to the aforementioned embodiment, including the torque limiting feature. Such a configuration may be necessary if the crown is comprised of a relatively brittle material, such as tungsten carbide, where forming recesses therein and engaging and reengaging a retaining member may cause the crown to crack. Thus, the blank is preferably formed of a more ductile material and the crown of a more abrasion-resistant material, with the recesses necessary for engagement of the retaining member formed in the blank.

In either of the aforementioned embodiments, a standardized shank could be manufactured to accommodate a variety of crown and/or cutter sizes and configurations. In yet another embodiment, the crown is configured to be inserted into the proximal end of the shank with the proximal end of the shank having a substantially cylindrical chamber formed therein to mate with the distal end of the crown. The torque limiting device of the aforementioned embodiments is utilized in a substantially similar manner to limit the torque that may be applied to the bit crown.

In still another preferred embodiment where the torque limiting device is part of the bit itself, a pair of bands is positioned between the shank and the blank with one band attached to each. The bands maintain relative position due to a frictional interference fit but can slide relative to one another if a predetermined torque is applied to the crown of the bit. In addition, the bands may have various orientations including vertical, horizontal, or any angle therebetween. Moreover, one or both of the bands may be comprised of a resilient material, such as synthetic elastomers, and the band material may be filled with particles or fibers of asbestos or other brake-material compounds. The location of the bands may be sealed from wellbore fluids, or the band materials may be selected to operate in the wellbore environment. Such a torque limiting device would act in a clutch-like manner where the bands remain in stationary relationship, so long as the force between them caused by torque on the crown does not exceed the static coefficient of friction between the bands. Moreover, the torque limiting device would have equal utility for tri-cone bits, as well as coring or other bits used in rotational-type drilling.

In yet another preferred embodiment, the torque limiting device includes a plurality of load-driven rollers (clutch rollers) that allows rotational movement when a predetermined torque or load is placed on the cutting structure of the bit.

In another preferred embodiment, a ratchet-type torque limiter may be comprised of two substantially concentric rings of similar or dissimilar materials, each having teeth or projections in engaging contact with one another that disengage when a predetermined torque is applied to the cutting structure of the bit.

In an alternate embodiment where the torque limiting device of the present invention is separate from the bit, the device couples a typical drill bit to a drill string and/or downhole motor. The torque limiting device includes connecting structures, such as threads, at both ends, one for attaching the device to the bit and one for attaching it to the drill string. The device may be formed as part of a downhole motor, or as a near-bit sub. Similar to the construction of the drill bit embodiments, the torque limiter may be comprised of two connecting structures that are fitted together in a male-female interconnection and held together by retaining members engaged in recesses formed in the internal wall of one connector. If sufficient torque is applied to the bit by the formation, the torque limiting device will allow the drill string to rotate relative to the bit.

As will be recognized, when the retaining members are disengaged from their respective recesses, the two connecting structures need not be axially mechanically attached to one another except for frictional forces applied by the retaining members on the internal wall of one connecting structure. Because the bit is being forced into the bottom of the wellbore, however, the two connecting structures are held together by the weight of the drill string. Thus, the two connecting structures will not become separated. The same is true for the embodiments where the torque limiting device is part of the bit construction. However, as required, additional structures as known in the art may be employed to help the two connecting structures remain secured together against longitudinal tensile forces encountered when tripping out of the wellbore.

It will be recognized by those skilled in the art that in any of the aforementioned embodiments, the configurations of the retaining and biasing members may vary. For example, the retaining member may simply be spherically shaped, cylindrically shaped, wedge shaped or otherwise suitably shaped including combinations thereof. Moreover, the retaining members may be biased by a segment of resilient material, a coil-type spring, a leaf spring, a belleville spring, or other means known in the art.

As noted above, a torque limiting device, in accordance with the present invention, will reduce the possibility of bit damage from excessive torque and will quickly signal the drilling operator through vibrations or shock waves that excessive torque is being applied to the drill bit.

DETAILED DESCRIPTION OF THE INVENTION

Figure 1:
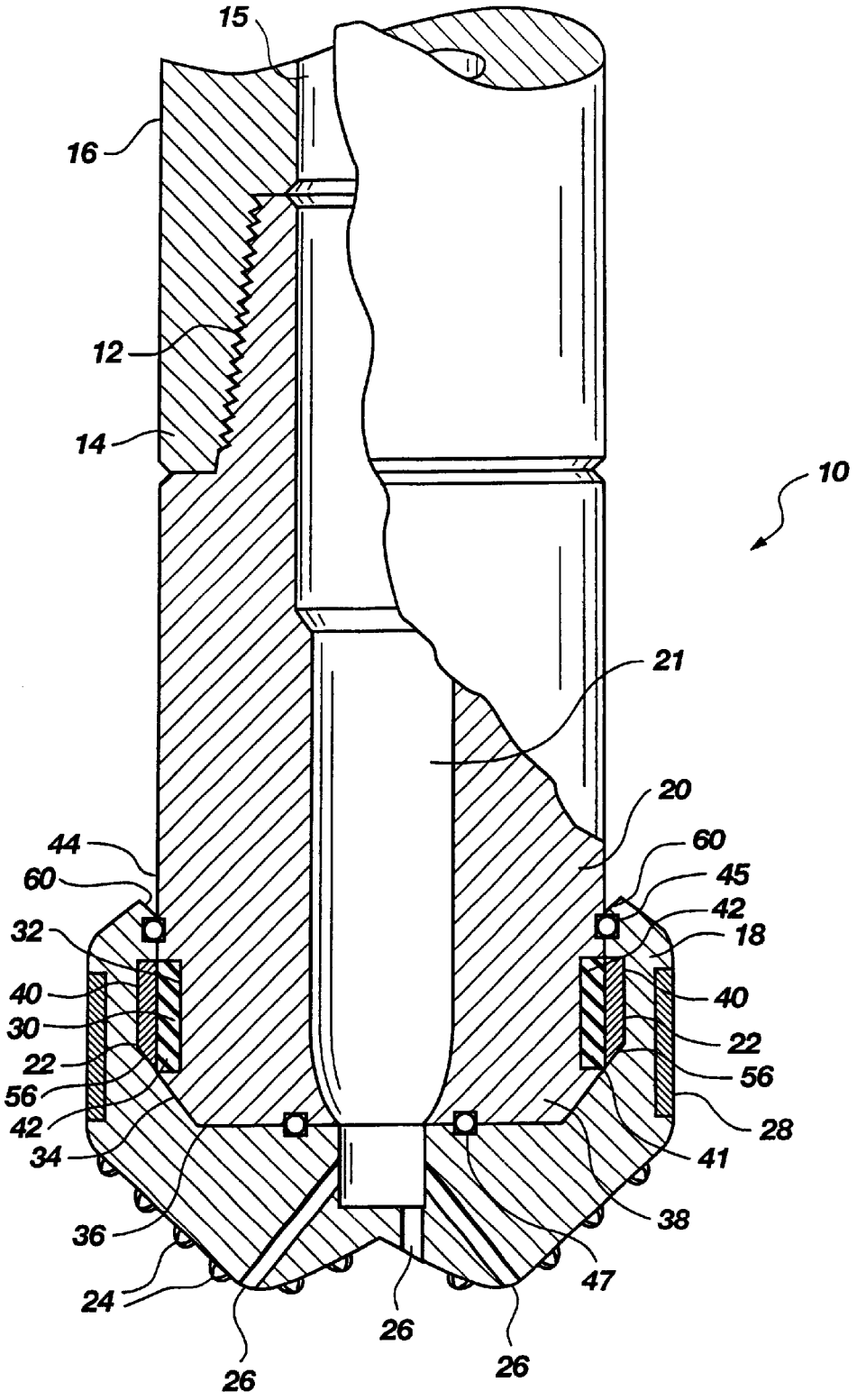
FIG. 1 is a partial sectional view of a drill bit including a first embodiment of a torque limiting device in accordance with the present invention.

FIG. 1 shows an exemplary drill bit 10, in accordance with the present invention, attached by threads 12 to an end 14 of a drill string 16. The drill bit 10 comprises a crown 18 attached to a shank 20 by the retaining members 22. The crown 18 may have a typical rotary bit exterior configuration including a plurality of cutting elements 24, nozzle exit ports 26, and gage pads 28. As with other similarly configured bits known in the art, the shank 20 includes a plenum 21 longitudinally extending through the shank 20 that is in fluid communication with the drilling fluid supply 15 of the drill string 16 and the nozzle exit ports 26 of the crown 18.

The crown 18 has an internal chamber 30 defined by walls 32 and 34 and floor 36. The internal chamber 30 is substantially cylindrically shaped and is sized to closely fit over the proximal end 38 of the shank 20, which also has a substantially cylindrical shape. The shank 20 and the crown 18 form a male-female interconnection such that the shank 20 may rotate within the internal chamber 30 of the crown 18.

As previously mentioned, the shank 20 is held in relative position to the crown 18 by retaining members 22 that protrude into recesses 40 formed in the wall 32 of the internal chamber 30. The retaining members 22 may be formed of steel, bronze or any other suitable material known in the art. The retaining members 22 are radially biased by the biasing members 42 positioned in recesses 41 formed in the outer surface 44 of the shank 20 proximate its proximal end 38. The biasing members 42 may be formed of a resilient elastomeric material, such as natural or synthetic rubber compounds, polyurethane or other materials known in the art and may have varying durometer ratings, depending on the desired resiliency to accommodate the design torque limit. In order to keep drilling fluid from the plenum 21 or from outside the drill bit 10 from entering between the shank 20 and the crown 18 and into the recesses 40 and 41, O-rings or other sealing structures 45 and 47 may be utilized to rotationally seal the crown 18 to the shank 20.

Figure 2:
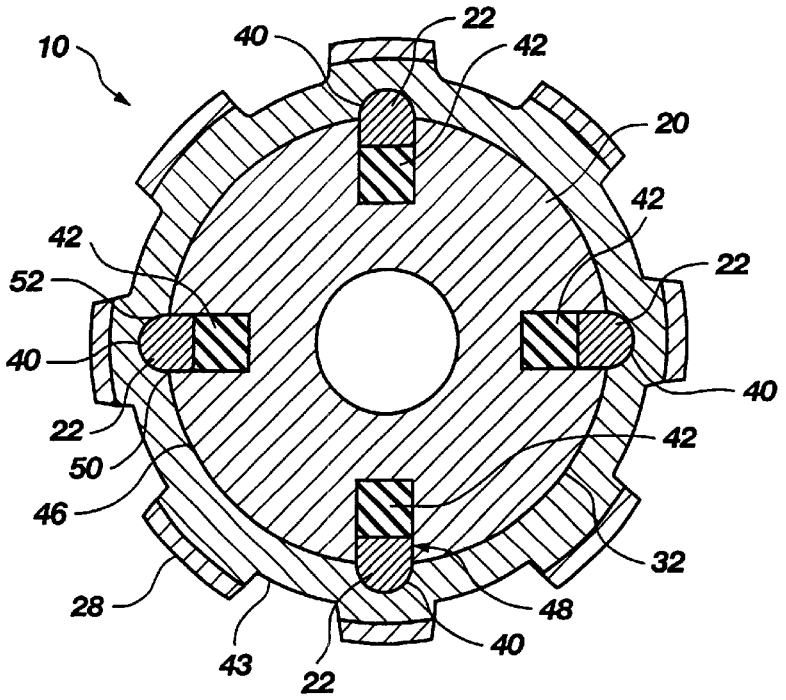
FIG. 2 is a cross-sectional view of the embodiment shown in FIG. 1.

As better shown in FIG. 2, the cross-section of the drill bit 10 illustrates the position of the junk slots 43 and the gage pads 28, relative to a plurality of retaining members 22 and biasing members 42, which are shown equidistantly placed about the perimeter 46 of the shank 20. The embodiment shown in FIG. 2 includes four torque limiting assemblies 48. As will be recognized by those skilled in the art, the number of torque limiting assemblies 48 is not critical and may include one or more. It is advantageous, however, to place a plurality of the torque limiting assemblies 48 equidistantly around the perimeter 46 of the shank 20 so that any one retaining member 22 may engage with any other recess 40.

Figure 2A:
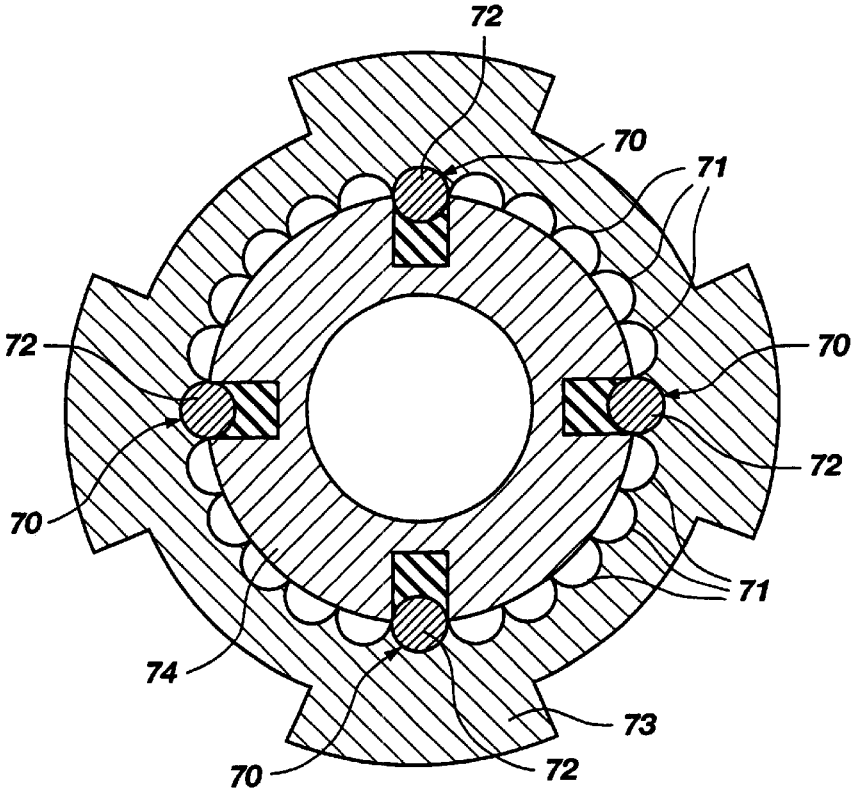
FIG. 2A is a cross-sectional view of a second embodiment of a torque limiting device in accordance with the present invention.

For example, as further illustrated in FIG. 2A, each torque limiting assembly 70 may engage with a plurality of different recesses 71. Moreover, while each retaining member 72, in the form of a substantially spherical ball, is illustrated as being forced into a recess 71 formed in the crown 73, those skilled in the art will recognize that the recesses 71 may with equal utility be formed in the shank 74 with each torque limiting assembly 70 fitted within the crown 73.

When a sufficient amount of torque is placed on the crown 18 of the drill bit 10 to load the retaining members 22 and force them radially into the biasing members 42, a distance that allows the retaining members 22 to clear the perimeter of interior wall 32 of internal chamber 30 of the crown 18, the shank 20 will rotate relative to the crown 18. In every quarter turn of the shank 20 relative to the crown 18, the retaining members 22 will reengage with the recesses 40. If the torque applied to the crown 18 is still sufficient to overcome the forces applied by the biasing members 42 on the retaining members 22, the shank 20 will continue to rotate. If not, the retaining members 22 will reengage with the next closest recess 40, and the crown 18 will then rotate along with the shank 20.

The retaining members 22 of the embodiment shown in FIGS. 1 and 2 have a substantially cylindrical cross-section with a flat side 50 used to provide uniform contact by the biasing member 42 along the length and width of the retaining member 22. It should also be noted that the rounded side 52 of the retaining member 22 must not extend a distance into the crown 18 such that the retaining member forms a mechanical lock between the crown 18 and the shank 20. That is, the rounded side 52 must be able to slide out of the recess 40 when a predetermined torque is applied to the bit crown 18. In addition, for assembly purposes, the retaining members 22 have a tapered portion 56 to slidedly engage with the beveled edge 60 of the crown 18. Thus, when the shank 20 and the crown 18 are slid together during assembly of the drill bit 10, the tapered portion 56 is assisted into the recess 41 by the beveled edge 60.

Figure 3:
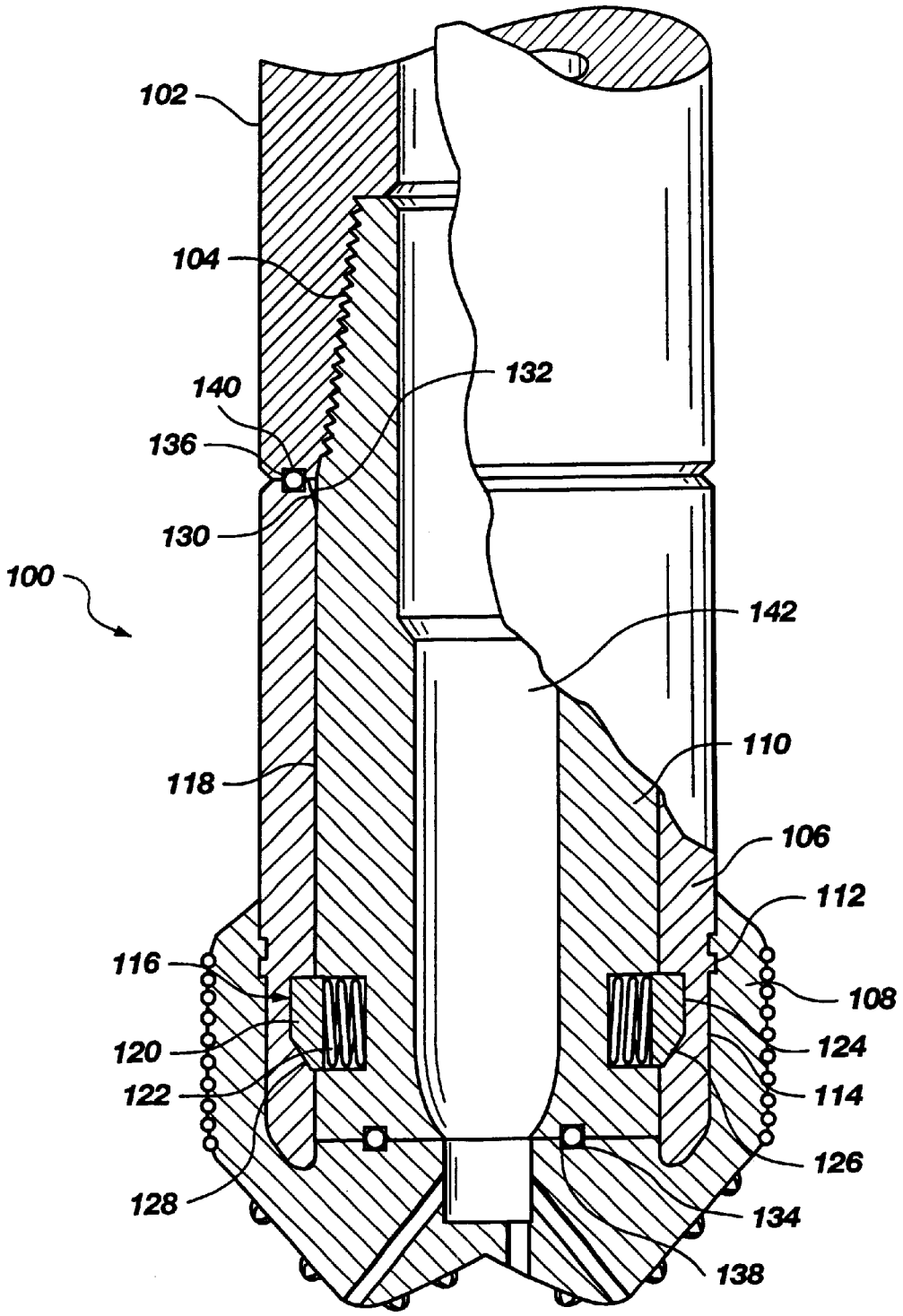
FIG. 3 is a partial sectional view of a drill bit including a third embodiment of a torque limiting device in accordance with the present invention.

Similar to the embodiment shown in FIG. 1, the drill bit 100, depicted in FIG. 3, is attached to a drill string 102 by a threaded portion 104. The drill bit 100, however, includes a substantially cylindrical tubular blank or crown insert 106, longitudinally extending along a length of the drill bit 100, positioned between the crown 108 and the shank 110 proximate its proximal end 114. The crown 108 is securely attached to the crown insert 106, which attachment may be assisted by protrusions 112, to mechanically hold the crown insert 106 relative to the crown 108.

The torque limiting assemblies 116 are located between the shank 110 and the crown insert 106 and proximate the proximal end 114. In this embodiment, however, it is not critical that the torque limiting assemblies 116 be located at or near the proximal end 114, and could therefore be positioned at any point along the interface 118 between the crown insert 106 and the shank 110. As in the previous embodiment, each torque limiting assembly 116 includes a retaining member 120 and a biasing member 122 (in this case a coil spring). Moreover, the retaining member 120, which is held into the recess 124 by the biasing member 122, has a tapered edge 126 at its proximal end 128. During the assembly process, when the shank 110 is slid into the crown insert 106, this tapered edge 126 contacts the beveled recess 130 located on the inner distal edge 132 of the crown insert 106 and helps to force the retaining member 120 into the crown insert 106. As better shown in FIG. 5, a cross-sectional view of the drill bit 100 taken through the interface between the crown insert 106 and the drill string 102, there are four such beveled recesses 130 positioned to correspond to each torque limiting assembly 116.

Figure 4:
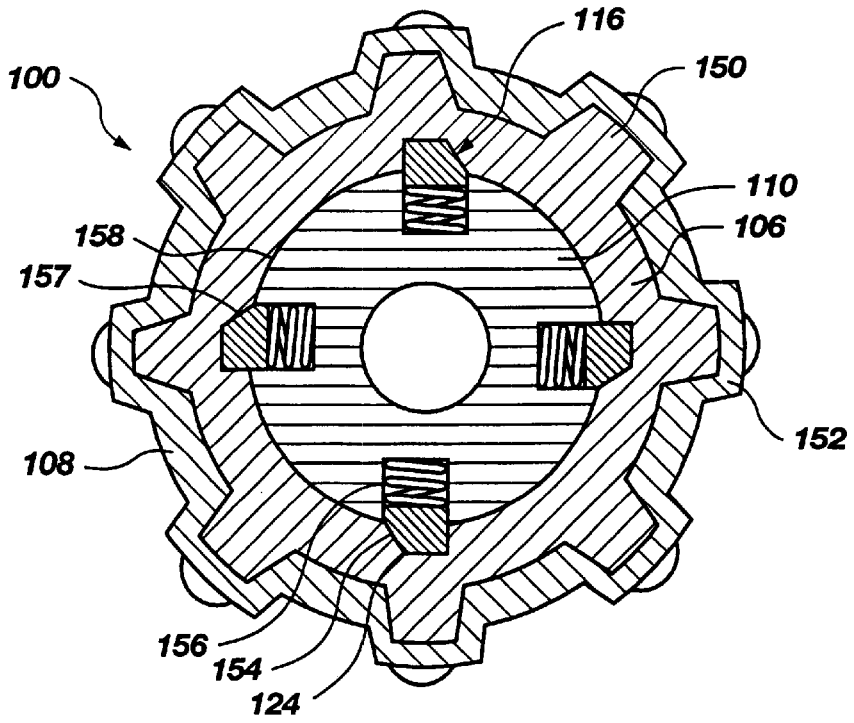
FIG. 4 is a cross-sectional view of the embodiment shown in FIG. 3.

Referring now to FIG. 4, depicting a cross-section of the drill bit 100 through the torque limiting assemblies 116, the crown insert 106 has a number of radially extending blades 150 corresponding to the external blades 152 of the crown 108. The crown insert 106 provides structural support for the crown 108 so that the crown 108 does not fracture during drilling. The retaining members 120 have a wedge-shaped cross-section with a tapered edge 154 which, when positioned in the recess 124, extends into the recess 156 to provide a sliding surface between the retaining member 120 and the edge 157 of the recess 124 at the inner surface 158 of the insert crown 106. Again, there are four, equidistantly spaced torque limiting assemblies 116. As one skilled in the art will recognize, however, there may be as few as one torque limiting assembly 116, or as many as will fit within the given space, depending on their size and configuration.

Figure 5:
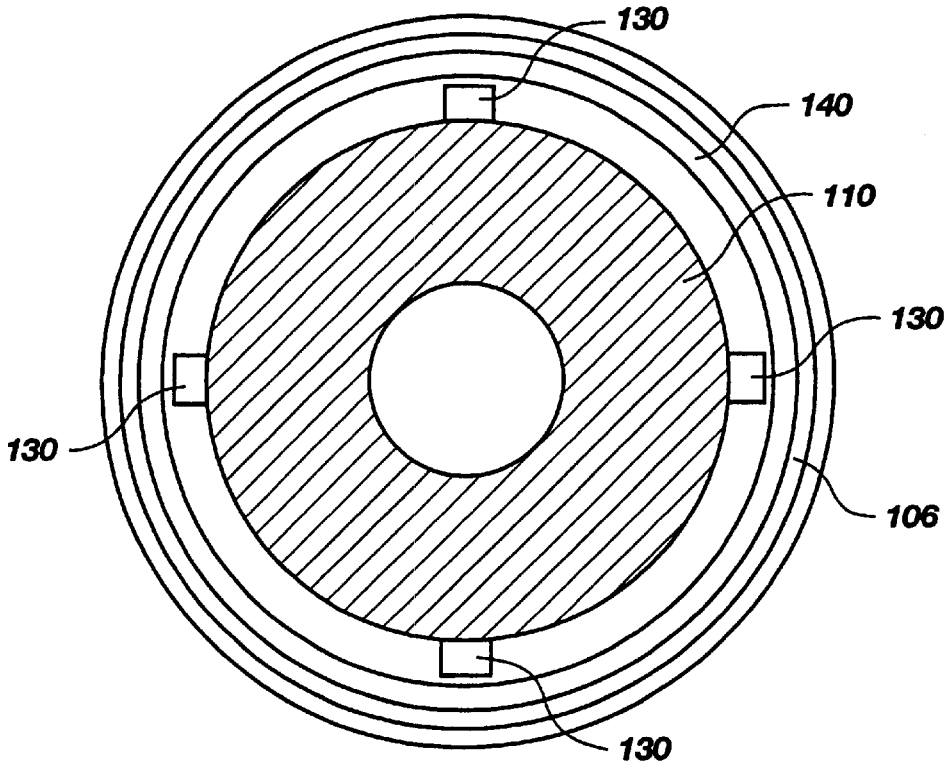
FIG. 5 is another cross-sectional view of the embodiment shown in FIG. 3.

As illustrated in FIG. 3, O-rings 134 and 136, or other seals as known in the art, placed in races 138 and 140, respectively, seal the torque limiting assemblies 116 from drilling fluid contained in the plenum 142 and drilling fluid located outside the drill bit 100. A top view of the O-ring race 140 is shown in FIG. 5.

Figure 6:
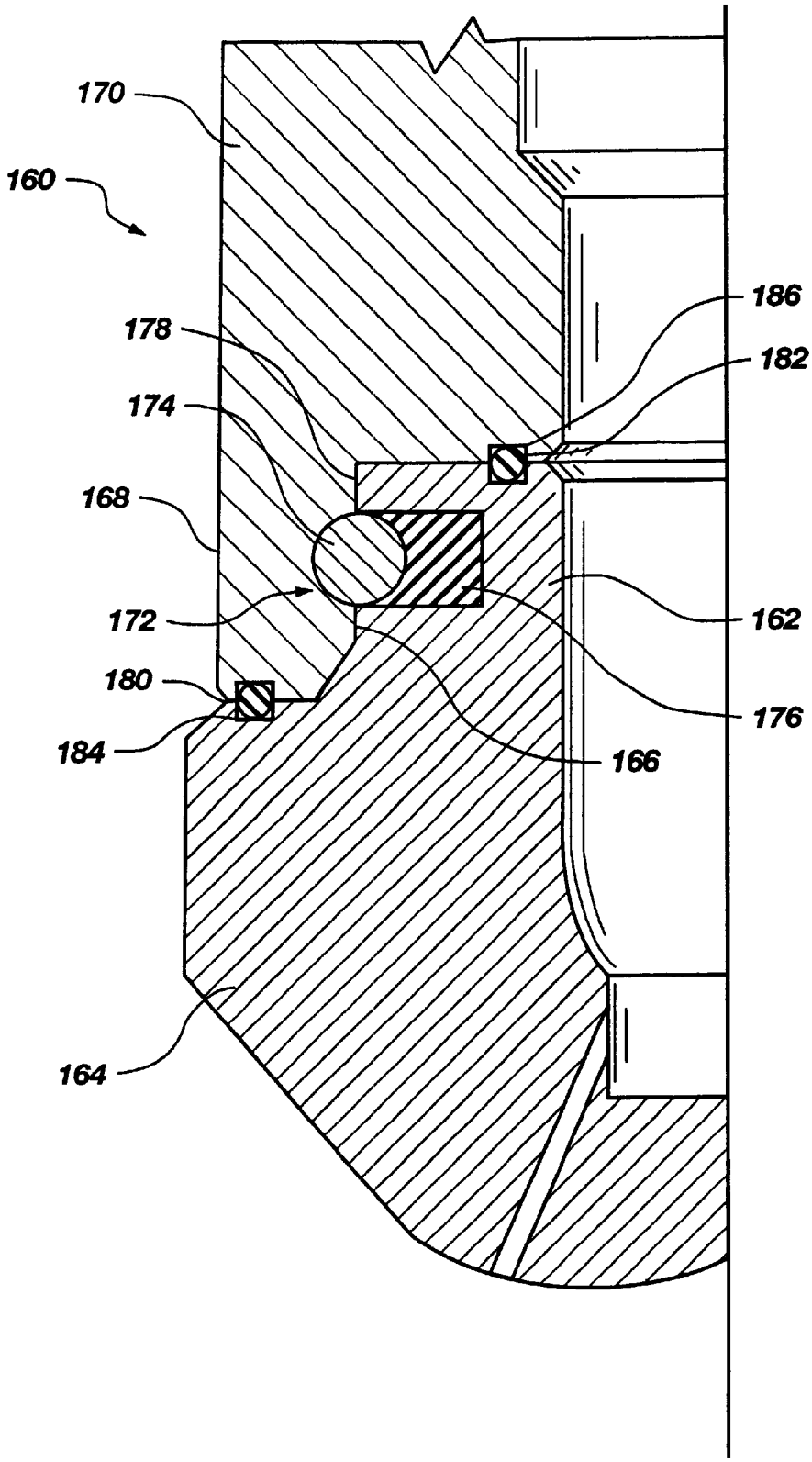
FIG. 6 is a partial sectional view of a drill bit including a fourth embodiment of a torque limiting device in accordance with the present invention.

FIG. 6 is a partial sectional view of an alternate preferred embodiment of a drill bit 160, in accordance with the present invention. In this embodiment, a portion 162 of the crown 164 actually fits in an internal chamber 166 defined by the proximal end 168 of the shank 170 in a male-female interconnection. Additionally, the torque limiting assembly 172 is comprised of a substantially spherically shaped retaining member 174 and a substantially cylindrical biasing member 176. Thus, the shank 170 can rotate relative to the crown 164 when a sufficient torque on the crown 164 forces the retaining member 174 toward the biasing member 176 enough that the retaining member 174 clears the wall 178 defining the internal chamber 166. O-rings 180 and 182 positioned in O-ring races 184 and 186, respectively, substantially seal the torque limiting assembly 172 from drilling fluid.

Figure 6A:
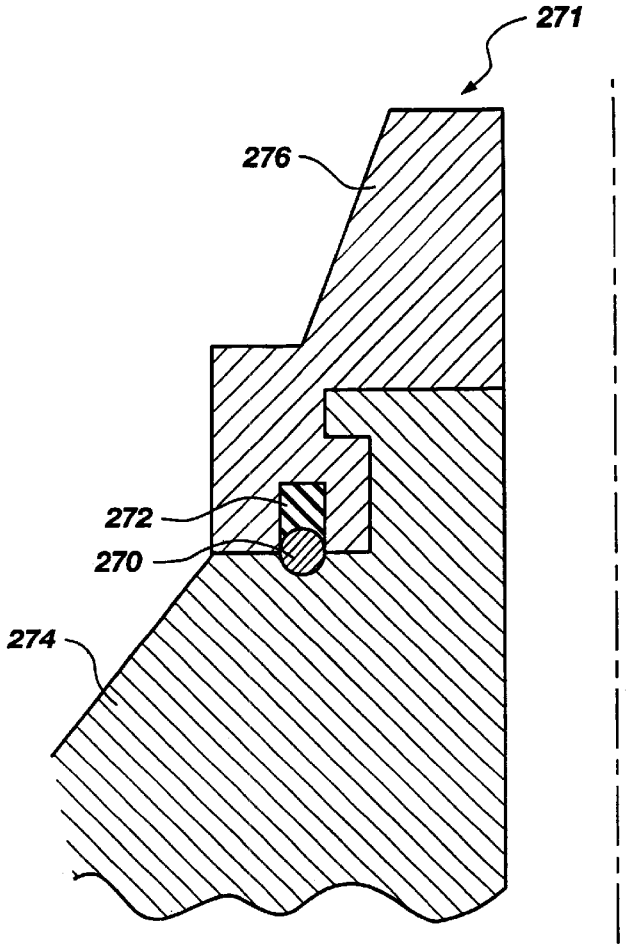
FIG. 6A is a partial sectional view of a drill bit including a fifth embodiment of a torque limiting device in accordance with the present invention.

Likewise, in FIG. 6A, the torque limiting feature of the drill bit 271 operates in a similar manner to that illustrated in FIG. 6. The retaining member 270 and biasing member 272, however, are vertically oriented between the crown 274 and the shank 276.

Figure 7:
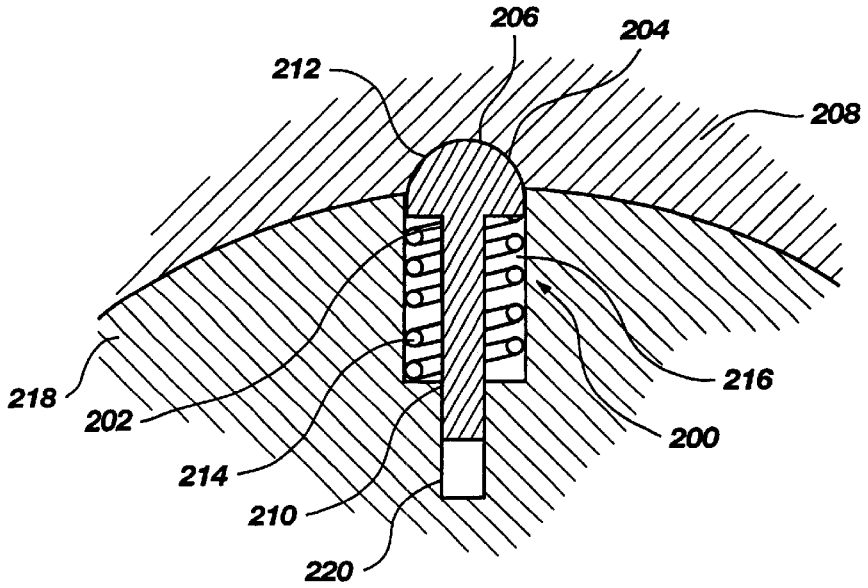
FIG. 7 is a sectional view of a sixth embodiment of a torque limiting device in accordance with the present invention.
Figure 7A:
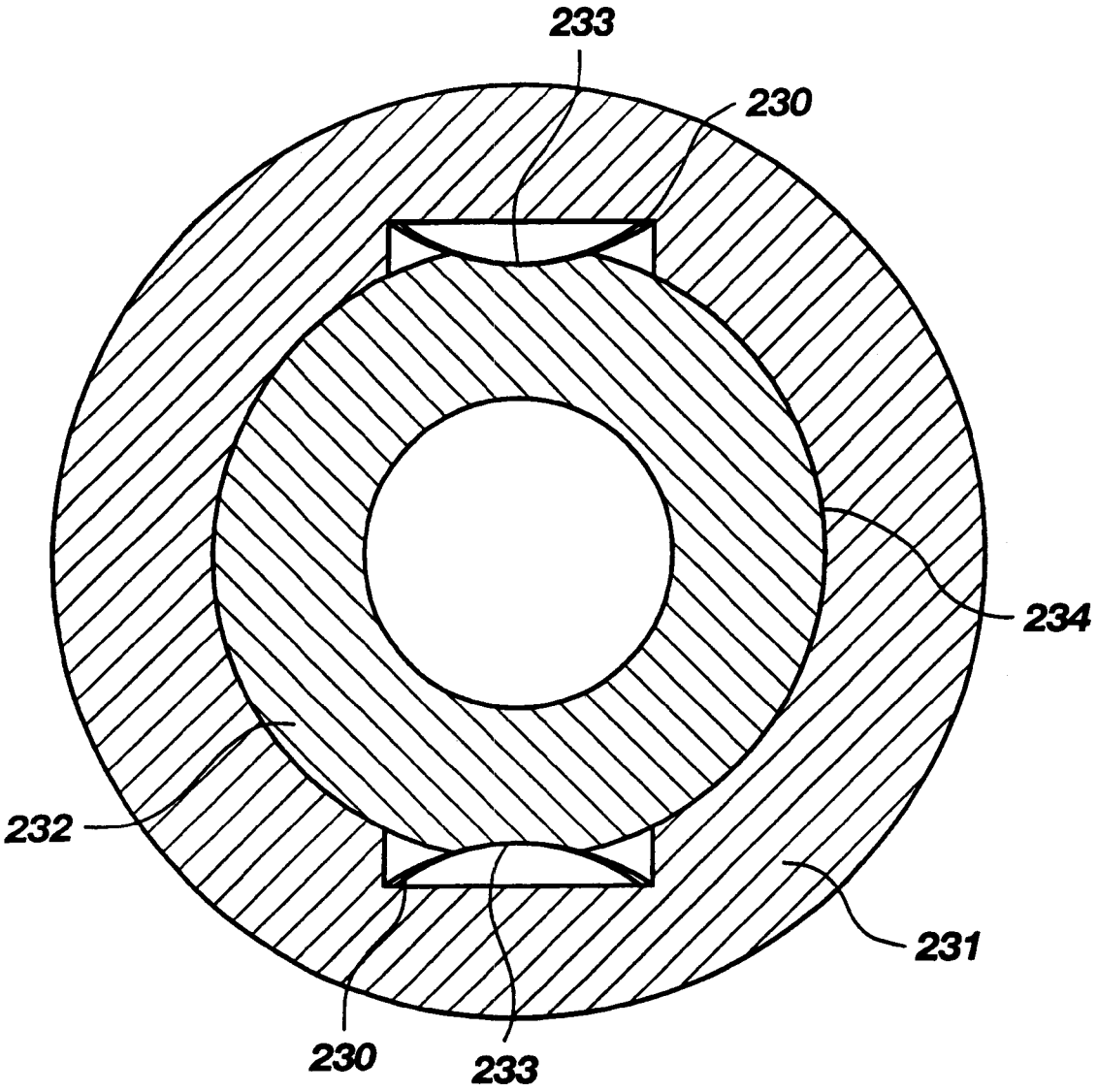
FIG. 7A is a cross-sectional view of a drill bit including a seventh embodiment of a torque limiting device in accordance with the present invention.

FIG. 7 illustrates that many modifications and/or combinations of the aforementioned embodiments of the torque limiting assembly 200 can be made without departing from the spirit of this invention. For example, the retaining member 202 may include a semi-spherical or semi-cylindrical portion 204 at its proximal end 206 for engagement with an insert or crown 208, as the case may be, and a guide rod or fin 210 to keep the portion 204 from rotating during disengagement and reengagement from the recess 212. The biasing member or coiled spring 214 sits in a first recess 216 formed in the shank 218. The first recess 216 is followed by a second recess 220, which is smaller and sized and shaped to accommodate the rod or fin 210 through its fall range of motion. Additionally, as illustrated in FIG. 7A, the retaining member and biasing member may be a single integral retaining component, such as spring 230. Such a spring 230 could hold the crown 231 relative to the shank 232 while engaged with engagement portions 233 in the outer surface 234 of the shank 232. As shown, the engagement portions 233 are comprised of recesses in the outer surface 234, but could just as well be flattened portions that would require deflection of the spring 230 to allow rotation of the crown 231 relative to the shank 232.

Figure 9:
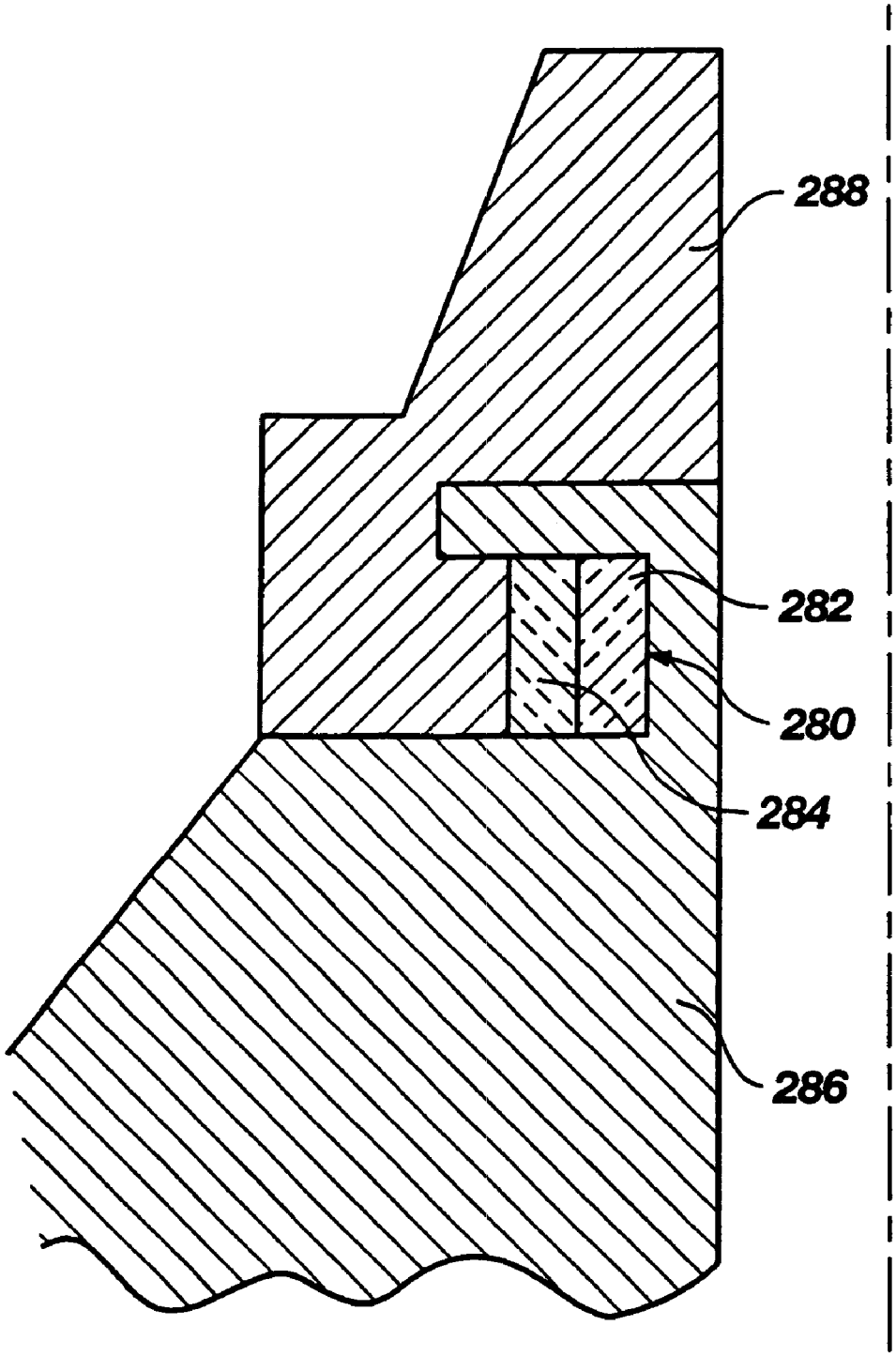
FIG. 9 is a partial sectional view of a drill bit including an eighth embodiment of a torque limiting device in accordance with the present invention.
Figure 9A:
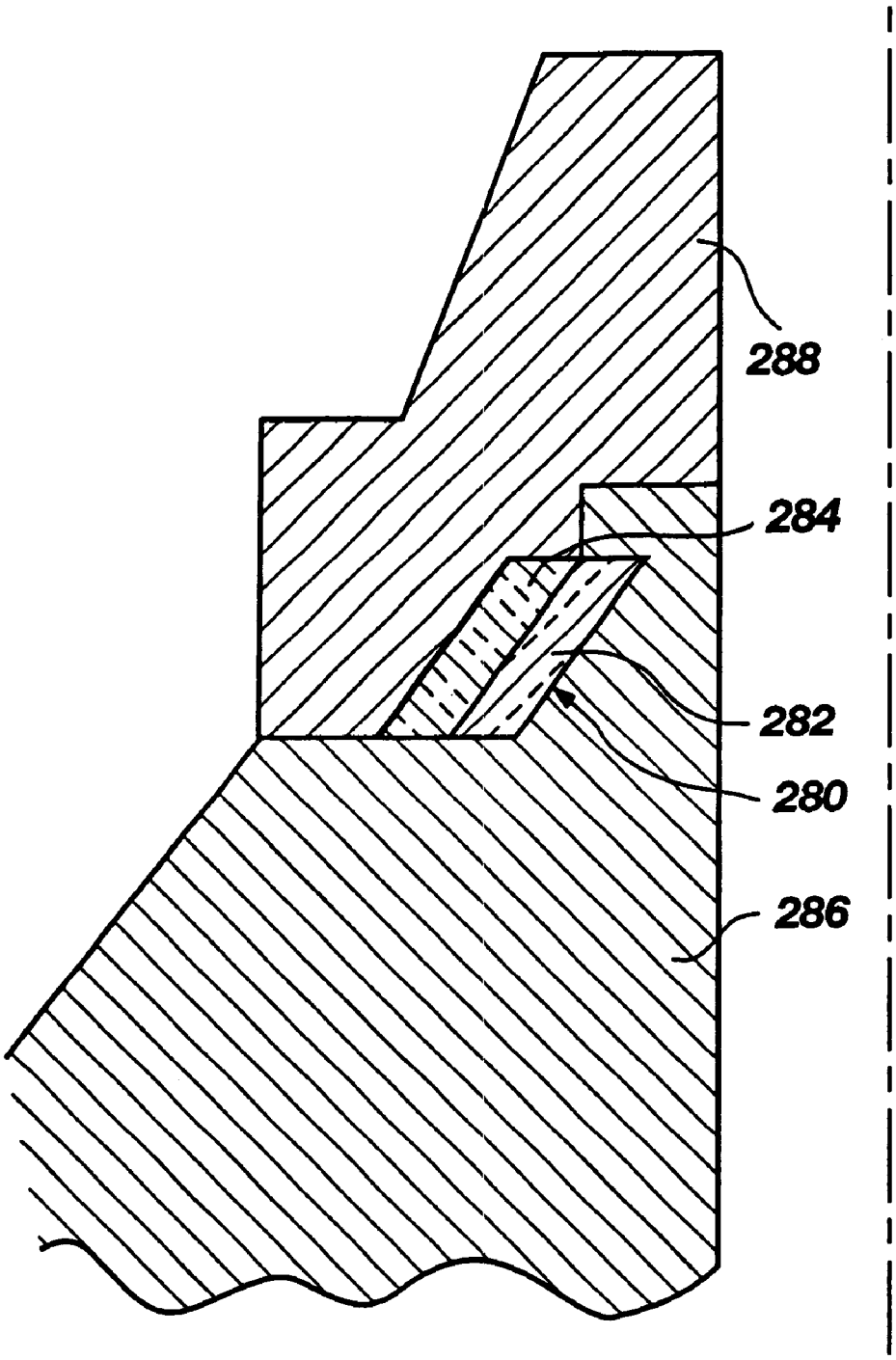
FIG. 9A is a partial sectional view of a drill bit including a ninth embodiment of a torque limiting device in accordance with the present invention.

While other preferred embodiments of the torque limiting assembly, according to the present invention, have been illustrated as including a biasing member and a retaining member, other devices which provide releasability between two drilling related structures are also contemplated. For example, as illustrated in FIGS. 9 and 9A, the torque limiting assembly 280 includes a pair of circumferential bands 282 and 284, at least one of which is comprised of an abrasion-resistant, yet resilient, material, the bands 282 and 284 being frictionally held in relative relation and adhesively or mechanically attached to the crown 286 and shank 288, respectively. The bands 282 and 284 remain in one relative position to one another so long as the force between the two bands 282 and 284 does not exceed the force holding the bands 282 and 284 together based on the coefficient of static friction between the two bands. Once the force holding the bands 282 and 284 together is exceeded, however, the bands will move relative to one another, allowing the crown 286 to rotate relative to the shank 288. In addition, the bands may be substantially vertically oriented as illustrated in FIG. 9, substantially horizontally oriented, or oriented at any angle thereinbetween, as further illustrated in FIG. 9A.

Figure 10:
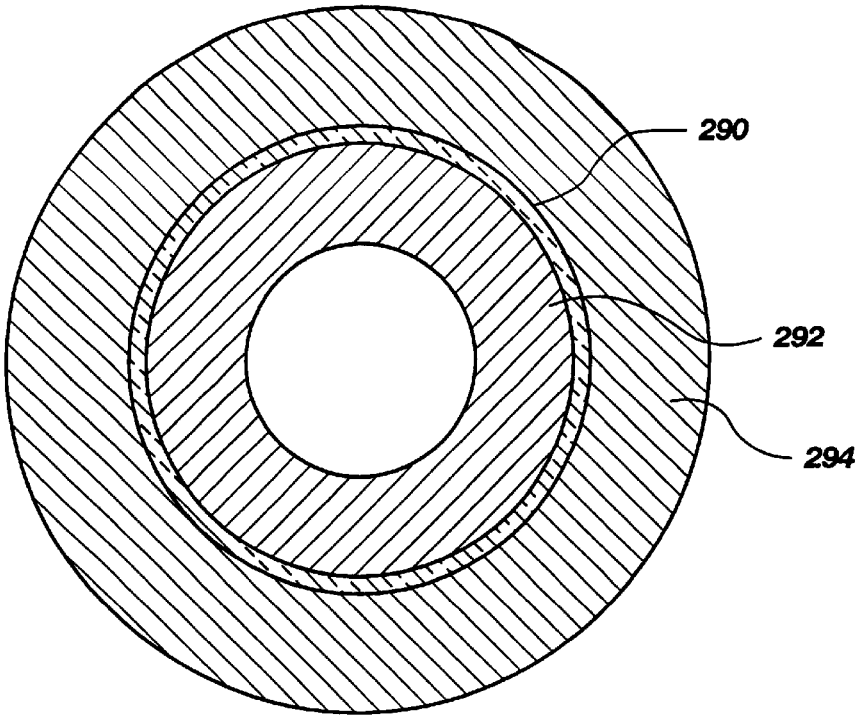
FIG. 10 is a cross-sectional view of a drill bit including a tenth embodiment of a torque limiting device in accordance with the present invention.

As further illustrated in FIG. 10, the torque limiting assembly may be comprised of a single friction band 290 interposed between the crown 292 and the shank 294. The band 290 may be attached to either the crown 292 or the shank 294, or not be attached at all. Accordingly, the crown 292 can rotate relative to the shank 294 when a torque placed on the crown 292 results in a force in excess of the static frictional force between the crown 292 and band 290 or the shank 294 and the band 290. Materials employed in brake linings and pads for motor vehicles may be especially suitable for band 290.

Figure 11:
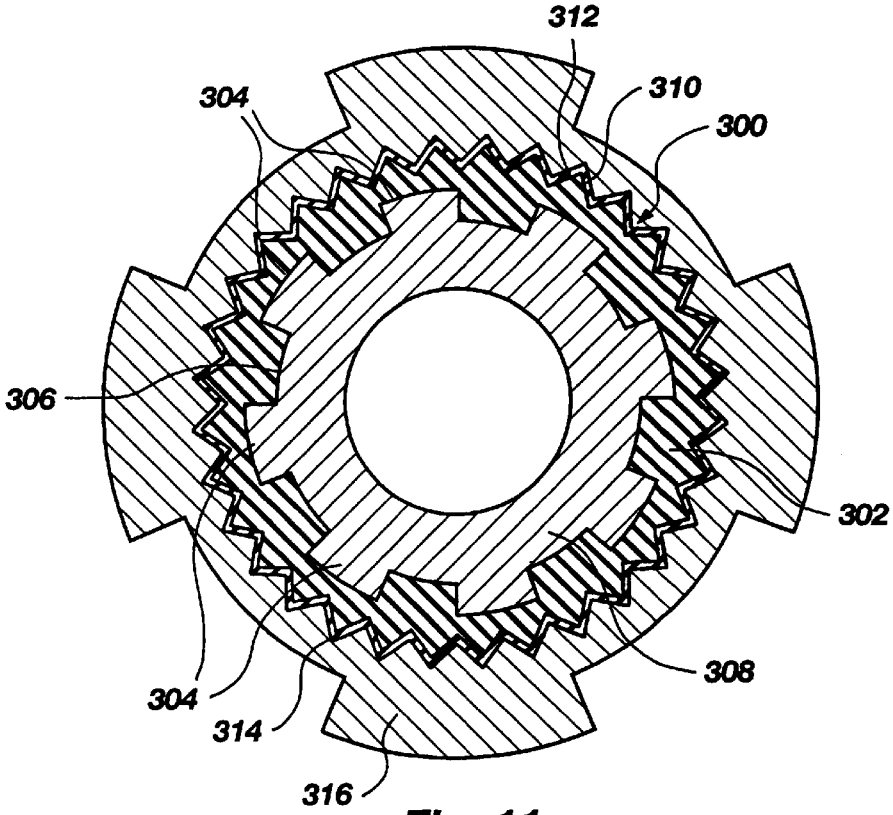
FIG. 11 is a cross-sectional view of a drill bit including an eleventh embodiment of a torque limiting device in accordance with the present invention.

In yet another preferred embodiment illustrated in FIG. 11, the torque limiting assembly 300 includes a band 302 of resilient material, such as an elastomer, that is mechanically attached to or molded onto and fitted around a plurality of protrusions 304 radially extending from an outer surface 306 of the shank 308. Accordingly, the band 302 is restricted from moving relative to the shank 308. The band 302 includes a layer 310 of wear-resistant material provided on its outer surface 312 that follows the contour of the outer surface 312 of the band 302. The outer surface 312 of the band 302, and more specifically the contour of the layer 310, is configured to substantially matingly match with the contour of the inner surface 314 of the crown 316. In this example, the inner surface 314 of the crown 316 is comprised of a zig-zag or corrugated, ribbed pattern that uniformly repeats around the inner surface 314. Thus, when a sufficient torque is applied to the crown 316, the crown 316 can rotate relative to the shank 308 with the layer 310 protecting the band 302 from being damaged or destroyed by the inner surface 314 of the crown 316. It will also be understood that while illustrated in a zig-zag configuration, the interface between the band 302 and the crown 316 may be similar to a sinusoidal wave, saw teeth, or any other desired pattern. Such an arrangement may be formed using an elastomer of one durometer for band 302 having molded thereon a second, higher-durometer layer 310. Polyurethanes are especially suitable for such an arrangement.

Figure 12:
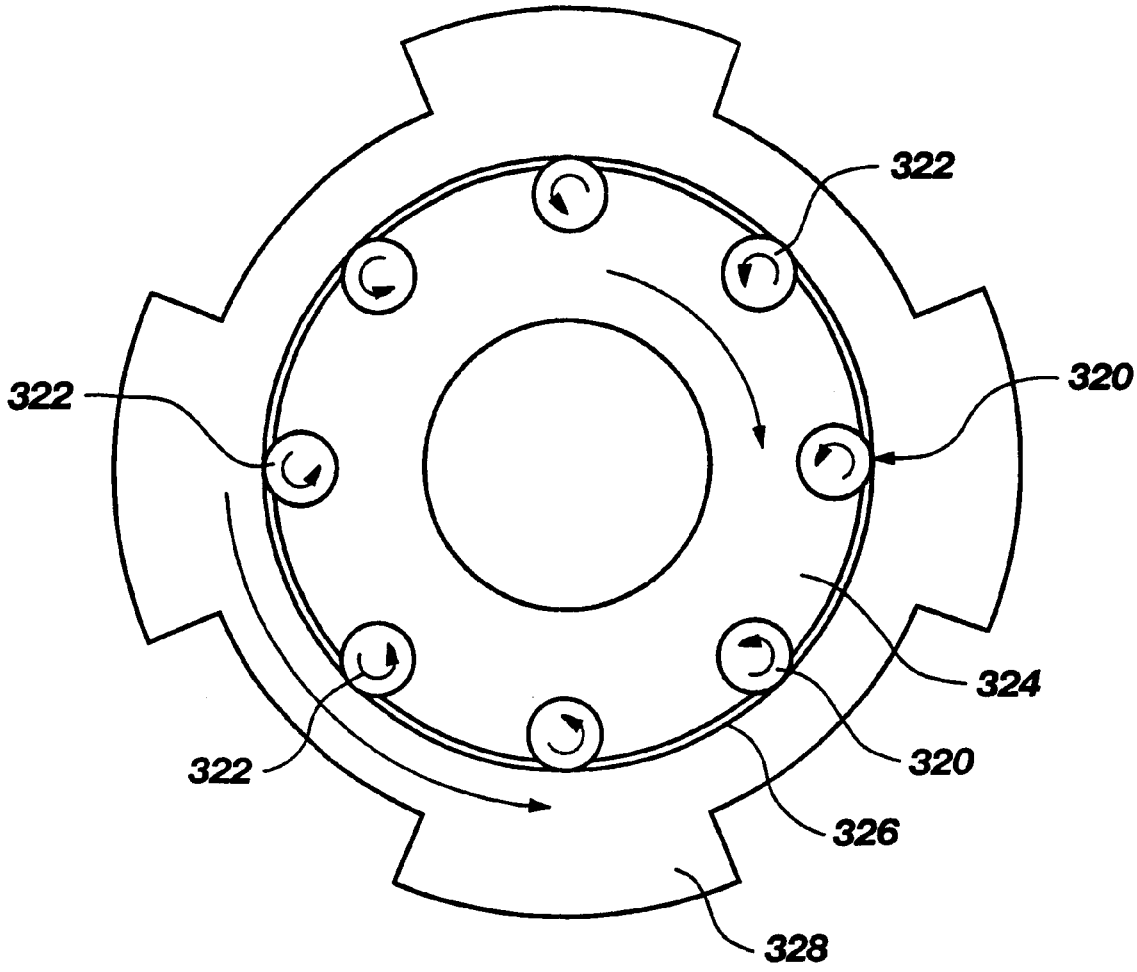
FIG. 12 is a cross-sectional view of a drill bit including a twelfth embodiment of a torque limiting device in accordance with the present invention.

Moreover, in FIG. 12, the torque limiting assembly 320 may include one or more rotatable clutch elements 322 held in fixed relation to the shank 324 but rotatable along an inner surface 326 of the crown 328 when sufficient torque is applied to the crown 328.

Figure 8:
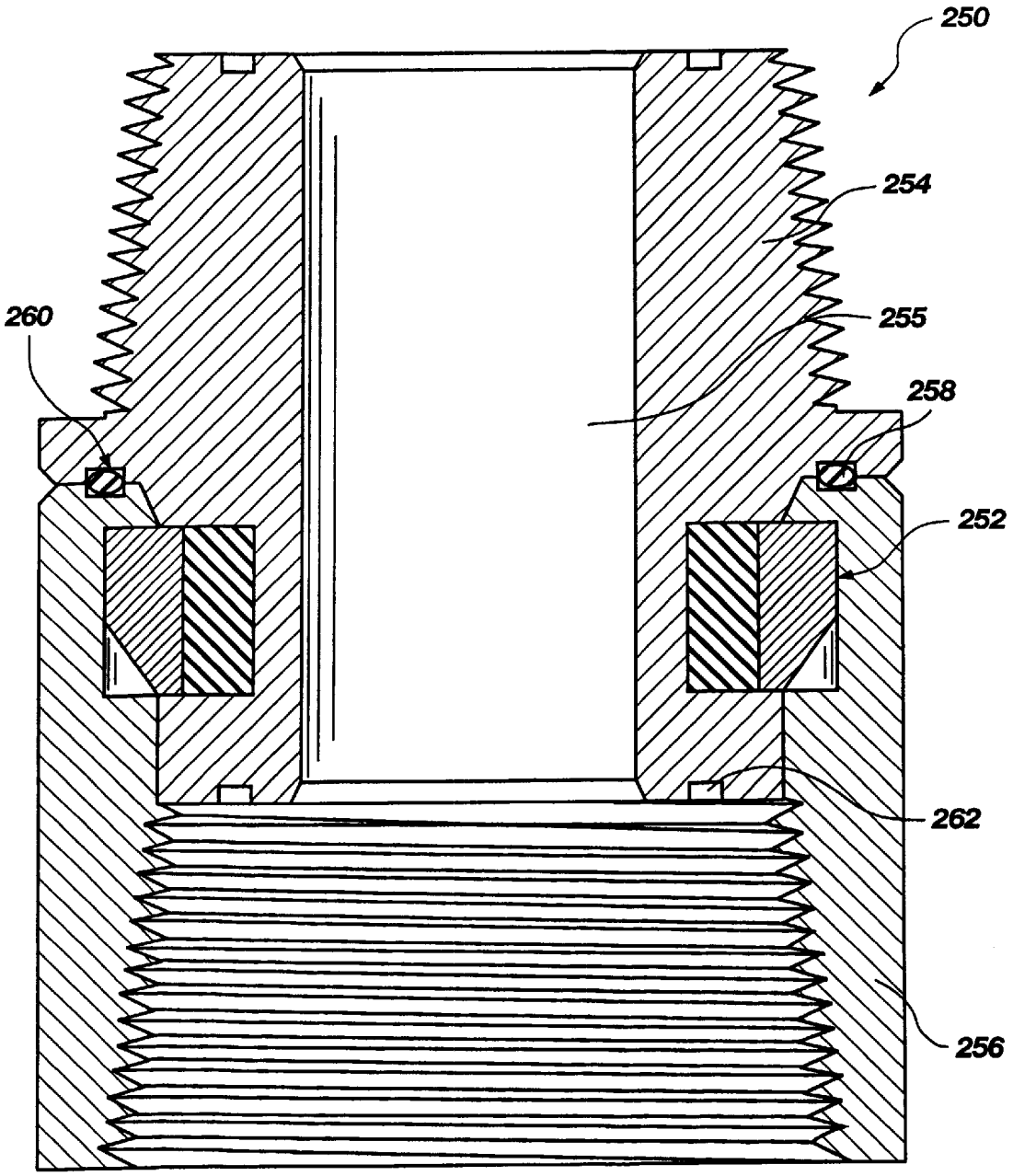
FIG. 8 is a partial cross-sectional view of an alternate embodiment of a retaining member and its associated biasing member positioned in a near-bit coupling device in accordance with the present invention.

It is also contemplated that the torque limiting device of the present invention may be incorporated into a near-bit coupling device 250, as illustrated in FIG. 8, which incorporates a torque limiting assembly 252, as previously described. The coupling device 250 is comprised of two interface structures or connectors 254 and 256. The first connector 254 would typically be attached to a drill string as known in the art and the second connector 256 would be attached to a typical drill bit. As with other embodiments described herein, the torque limiting assemblies 252 are releasable and allow rotational movement of the first interface structure or connector 254 relative to the second interface structure or connector 256. The coupling device 250 also includes a plenum 255 to allow passage of drilling fluid from a drill string to a drill bit. O-ring 258 placed in race 260 and another O-ring placed in race 262 could help seal the torque limiting assemblies 252 and the coupling device 250 relative to a connected drill string and bit. Such a coupling device 250, incorporating a torque limiting assembly 252, would allow a typical bit to have torque limiting abilities without modifying the bit itself or the manufacturing of such a bit.

It will be appreciated by those of ordinary skill in the art that use of the present invention facilitates the use of drag bits having aggressive PDC cutters, such as those with minimal or no back rake or even a forward (positive) rake of the cutting faces. Prior art bits, in part, employ negatively back raked cutters to limit torque, but this also limits ROP, so runs take longer for a given borehole interval in the interests of preserving the bit and string against damage.

During a drilling operation utilizing a drill bit incorporating a torque limiting device in accordance with the present invention, if the crown of the bit ceases rotation, the vibrations generated by the disengagement and reengagement of the torque limiting device will quickly signal the operator that the crown is not rotating. Drilling parameters can then be promptly adjusted to decrease the WOB applied on the bit crown or, in the case of a downhole motor, the drilling fluid flow as well as WOB.

Figure 13:
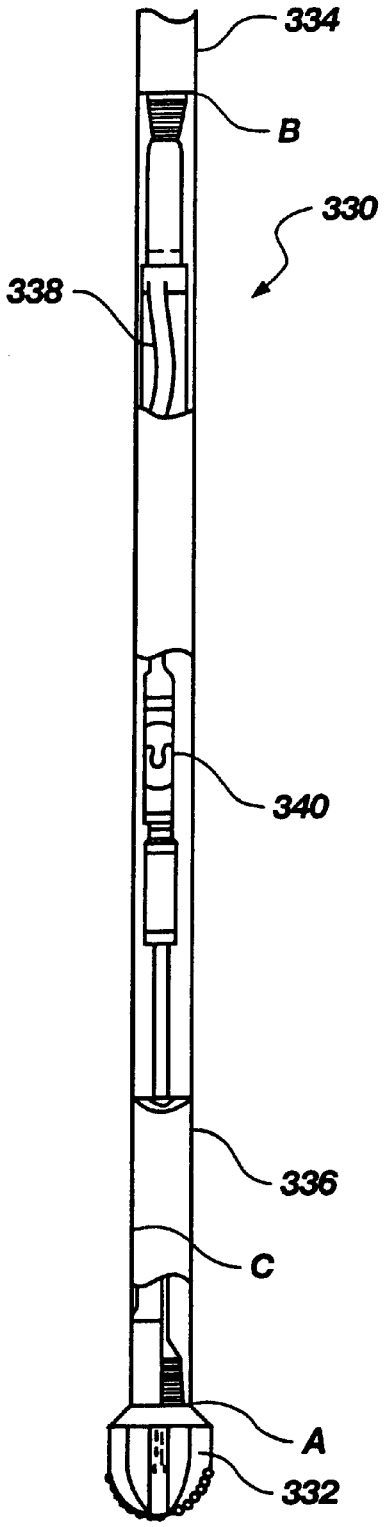
FIG. 13 is a partial sectional view of a downhole motor including a torque limiting device in accordance with the present invention.

It will be appreciated by those skilled in the art that many modifications and combinations of the preferred embodiments can be made without departing from the scope of the invention and particularly the appended claims. More specifically, features of the torque limiting device that have been illustrated as an integral part of the drill bit could be incorporated into a near-bit torque limiting device or anywhere between the drill string and the drill bit. For example, as illustrated in FIG. 13, a torque limiting device could be incorporated at a variety of locations along a downhole motor 330. A torque limiting device, according to the present invention, may have utility at point A between a downhole motor 330 and drill bit 332, at point B between motor 330 and drill string 334, or even at point C within downhole motor 330 as, for example, within bearing housing 336 below the rotor/stator section 338 and connecting rod assembly 340. In addition, the torque limiting device, while being illustrated with respect to a fixed-cutter bit, will have equal utility when used with or as an integral part of a roller cone bit (also called "tri-cone" or "rock" bit), as well as coring or other bits used in rotational-type drilling. Moreover, those skilled in the art will appreciate that configurations of the components could be interchanged between embodiments, such as changing the type and/or shape of the retaining member and/or the type and/or shape of the biasing member. Further, the arrangement of torque limiting assemblies may be reversed so that the retaining members are radially inwardly biased by biasing members carried by the crown (or blank) into cooperating recesses formed in the shank. Thus, it is believed that the essence of the invention is to provide a torque limiting device in a drill bit or between a drill string or downhole motor, as is known in the art, and a bit so that the drill string or motor drive shaft can continue to rotate while the crown of the bit remains stationary once a predetermined torque is exceeded by the drill bit.

What is claimed is:

1. A method of manufacturing a rotary drill bit, comprising:

forming a crown including at least one recess therein;

forming a shank sized and shaped to mate with the crown including at least one recess positioned to be in substantial alignment with the at least one recess of the crown after assembly of the bit;

selecting a biasing member for placement in one of the at least one recess of the shank and the at least one recess of the crown and adjacent a retaining member at least partially disposed within the one of the at least one recess of the shank at the at least one recess of the crown for transmission of torque applied to the crown, the selecting including selecting the biasing member to yield upon a torque applied to the crown which exceeds an predetermined torque;

placing the biasing member in one of the at least one recess of the shank and the at least one recess of the crown;

placing the retaining member at least partially within the one of the at least one recess of the shank and the at least one recess of the crown and adjacent the biasing member; and assembling the crown to the shank so that the retaining member engages the other of the at least one recess of the crown and the at least one recess of the shank.

2. The method of claim 1, further including forming a substantially cylindrical inner chamber in the crown and forming the shank to be substantially cylindrical and sizing the shank to closely fit within the substantially cylindrical inner chamber.

3. The method of claim 1, further including forming at least one tapered portion in an upper edge of the crown to facilitate initial engagement of the retaining member with the crown.

4. The method of claim 1, wherein forming the crown including at least one recess therein comprises forming at least one recess of the crown in a crown insert, and further including securing the crown to the crown insert and engaging the crown insert and the shank until the retaining member engages the at least one recess of the crown insert.

5. The method of claim 4, further including forming at least one tapered portion in an upper edge of the crown insert to facilitate initial engagement of the retaining member with the at least one recess of the crown insert.

6. The method of claim 4, wherein placing the retaining member at least partially within the one of the at least one recess of the shank and at least one recess of the crown insert comprises placing the retaining member to be biased in a generally radially direction by the biasing member.

7. The method of claim 6, wherein placing the retaining member at least partially within the one of the at least one recess of the shank and at least one recess of the crown insert comprises placing a retaining member having a shape selected from the group consisting of a substantially cylindrical shape, a substantially wedge shape, and a substantially spherical shape.

8. The method of claim 4, wherein forming the at least one recess in the crown insert comprises forming a plurality of recesses in the crown insert and wherein forming the shank comprises forming the shank to include a plurality of the recesses therein.

9. The method of claim 8, wherein placing the retaining member at least partially within the one of the at least one recess of the shank and the at least one recess of the crown insert comprises placing a plurality of the retaining members at least partially within a plurality of the one of the plurality of recesses of the shank and the plurality of recesses of the crown insert.

10. The method of claim 1, wherein placing the retaining member at least partially within the one of the at least one recess of the shank and the at least one recess of the crown comprises placing the retaining member to be biased in a generally radially direction by the biasing member.

11. The method of claim 10, wherein placing the retaining member at least partially within the one of the at least one recess of the shank and the at least one recess of the crown comprises placing a retaining member having a shape selected from the group consisting of a substantially cylindrical shape, a substantially wedge shape, and a substantially spherical shape.

12. The method of claim 1, wherein forming the crown and forming the shank comprise forming the crown and forming the shank so as to be mateable in a male-female relationship.

13. The method of claim 12, wherein forming the crown further comprises forming the crown to receive a distal portion of the shank and wherein assembling the crown to the shank comprises disposing the distal portion of the shank in the crown.

14. The method of claim 1, wherein forming the shank sized and shaped to mate with the crown comprises forming the shank to include structure for connecting the bit to a drill string.

15. The method of claim 1, wherein forming the crown comprises forming the crown to include a plurality of recesses therein and wherein forming the shank comprises forming the shank to include a plurality of recesses therein.

16. The method of claim 15, wherein placing the retaining member at least partially within the one of the at least one recess of the shank and the at least one recess of the crown comprises placing a plurality of the retaining members at least partially within a plurality of one of the plurality of recesses of the shank and the plurality of recesses of the crown.

17. The method of claim 1, further comprising disposing at least one seal between the crown and the shank to provide a fluidic seal therebetween.

18. The method of claim 1, wherein placing the retaining member at least partially within the one of the at least one recess of the shank and the at least one recess of the crown comprises placing a retaining member having a shape selected from the group consisting of a substantially cylindrical shape, a substantially wedge shape, and a substantially spherical shape.

* * * * *

UNITED STATES PATENT AND TRADEMARK OFFICE

CERTIFICATE OF CORRECTION

PATENT NO. : 6,357,538 B2
APPLICATION NO. : 09/731109
DATED : March 19, 2002
INVENTOR(S) : Gordon A. Tibbitts It is certified that error appears in the above-identified patent and that said Letters Patent is hereby corrected as shown below:

On the title page:
In ITEM (56) "References Cited,
U. S. Patent Documents,"

| | | | |
|---|---|---|---|
| PAGE 1, | COLUMN 2 | LINE 11, | change "4,511,050 A 4/1985 Hughes et al." to --4,551,050 A 11/1985 Hughes et al.-- |
| PAGE 1, | COLUMN 2, | LINE 15, | after "4,768,598 A" insert an asterisk |
| PAGE 2, | COLUMN 2, | LINE 13, | after "5,695,015 A" insert an asterisk |

In the drawings:

| | | | |
|---|---|---|---|
| | | FIG. 4, | insert reference numeral --120-- with associated lead line |

In the specification:

| | | | |
|---|---|---|---|
| | COLUMN 7, | LINE 66, | delete "bit" |
| | COLUMN 11, | LINE 20, | change "motor 330" to --downhole motor 330-- |

UNITED STATES PATENT AND TRADEMARK OFFICE

CERTIFICATE OF CORRECTION

PATENT NO. : 6,357,538 B2
APPLICATION NO. : 09/731109
DATED : March 19, 2002
INVENTOR(S) : Gordon A. Tibbitts It is certified that error appears in the above-identified patent and that said Letters Patent is hereby corrected as shown below:

Replace FIG. 4, with the following:

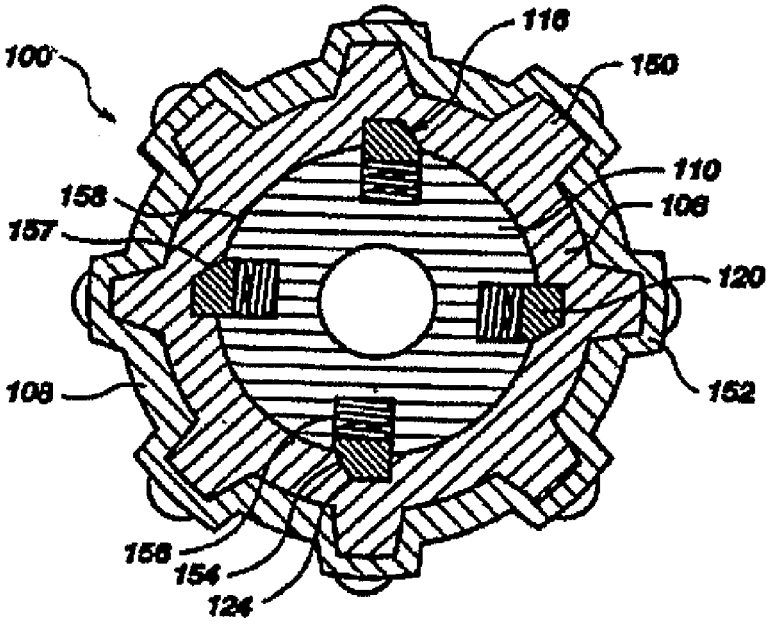

*Fig. 4*

Signed and Sealed this

Sixth Day of February, 2007

JON W. DUDAS
*Director of the United States Patent and Trademark Office*